US010234076B2

(12) United States Patent
Liu et al.

(10) Patent No.: US 10,234,076 B2
(45) Date of Patent: Mar. 19, 2019

(54) METHOD AND SYSTEM FOR REGULATING CRYOGENIC VAPOR PRESSURE

(71) Applicant: The Boeing Company, Chicago, IL (US)

(72) Inventors: Shengyi Liu, Sammamish, WA (US); Lijun Gao, Renton, WA (US)

(73) Assignee: The Boeing Company, Chicago, IL (US)

( * ) Notice: Subject to any disclaimer, the term of this patent is extended or adjusted under 35 U.S.C. 154(b) by 203 days.

(21) Appl. No.: 15/359,746

(22) Filed: Nov. 23, 2016

(65) Prior Publication Data

US 2017/0074459 A1 Mar. 16, 2017
US 2018/0066801 A9 Mar. 8, 2018

Related U.S. Application Data

(62) Division of application No. 13/274,927, filed on Oct. 17, 2011, now Pat. No. 9,574,711.

(51) Int. Cl.

*F17C 13/00* (2006.01)
*F17C 13/02* (2006.01)
*F25B 21/04* (2006.01)

(52) U.S. Cl.

CPC ..... *F17C 13/025* (2013.01); *F17C 13/00* (2013.01); *F17C 13/026* (2013.01); *F25B 21/04* (2013.01); *F17C 2201/0109* (2013.01); *F17C 2201/032* (2013.01); *F17C 2203/032* (2013.01); *F17C 2203/0391* (2013.01); *F17C 2203/0629* (2013.01); *F17C 2203/0643* (2013.01); *F17C 2221/033* (2013.01); *F17C 2223/0161* (2013.01); *F17C 2223/033* (2013.01); *F17C 2223/047* (2013.01); *F17C 2227/0107* (2013.01); *F17C 2227/0302* (2013.01); *F17C 2227/0304* (2013.01); *F17C 2227/0337* (2013.01); *F17C 2227/0381* (2013.01); *F17C 2250/032* (2013.01); *F17C 2250/034* (2013.01); *F17C 2250/043* (2013.01); *F17C 2250/0439* (2013.01); *F17C 2250/0626* (2013.01); *F17C 2250/0631* (2013.01); *F17C 2265/03* (2013.01); *F17C 2265/033* (2013.01); *F17C 2265/036* (2013.01); *F25B 2321/0212* (2013.01)

(58) Field of Classification Search

CPC ..... F17C 2265/033; F17C 2265/036; F17C 13/002; F17C 13/00; F17C 2227/0304; F17C 2227/0337; F17C 2227/0381; F17C 2250/043; F25B 21/02; F25D 31/006

See application file for complete search history.

(56) References Cited

U.S. PATENT DOCUMENTS 2,790,307 A 4/1957 Ayres
3,191,395 A 6/1965 Maher et al.
(Continued)

OTHER PUBLICATIONS

International Search Report and Written Opinion of International Application No. PCT/US2012/055795; dated Jan. 28, 2013; 13 pages.

*Primary Examiner* — Elizabeth J Martin
(74) *Attorney, Agent, or Firm* — Armstrong Teasdale LLP

(57) ABSTRACT

A vapor pressure regulation system includes a vessel including a vessel wall that defines an enclosure, and a temperature adjustment mechanism coupled to the vessel. A heat transfer between the temperature adjustment mechanism and the vessel is adjusted based on at least a vapor pressure within the vessel to facilitate regulating the vapor pressure within the vessel.

20 Claims, 4 Drawing Sheets

(56) References Cited

U.S. PATENT DOCUMENTS

| | | | |
|---|---|---|---|
| 4,593,529 | A | 6/1986 | Birochik |
| 5,150,578 | A | 9/1992 | Oota et al. |
| 5,415,196 | A | 5/1995 | Bryant et al. |
| 5,690,849 | A | 11/1997 | Devilbiss et al. |
| 6,089,226 | A | 7/2000 | Gier |
| 6,363,728 | B1 | 4/2002 | Udischas et al. |
| 6,474,077 | B1 | 11/2002 | Botelho et al. |
| 6,505,468 | B2 | 1/2003 | Venkatasubramanian |
| 6,662,570 | B2 | 12/2003 | Venkatasubramanian |
| 6,921,858 | B2 | 7/2005 | Bingham |
| 2004/0250551 | A1 | 12/2004 | Schnagl |
| 2006/0180192 | A1 | 8/2006 | Sharp et al. |
| 2007/0068176 | A1 | 3/2007 | Pozivil |

METHOD AND SYSTEM FOR REGULATING CRYOGENIC VAPOR PRESSURE

CROSS-REFERENCE TO RELATED APPLICATIONS

This application is a divisional and claims priority to U.S. patent application Ser. No. 13/274,927 filed Oct. 17, 2011 for "METHOD AND SYSTEM FOR REGULATING CRYOGENIC VAPOR PRESSURE", which is hereby incorporated by reference in its entirety.

BACKGROUND

The present disclosure relates generally to cryogenic storage systems and, more particularly, to methods and systems for use in regulating vapor pressure within a vessel.

At least some known cryogenic liquid storage systems are required to operate within a predetermined pressure range to ensure safe operation of a pressure vessel. Even with excellent thermal insulation of the pressure vessel, a small amount of heat may penetrate into at least some pressure vessels through its vessel walls and/or through its insertions. As such, vapor pressure may build up within the pressure vessel, which, over time, may create safety hazards.

To facilitate controlling vapor pressure within at least some known pressure vessels, at least some vessels include relief system that periodically release vapor to facilitate decreasing the internal vapor pressure. However, in at least some applications, releasing reactant vapor into a closed environment may be hazardous and/or may cause a loss of reactant, thereby reducing utilization. In such applications, a Joule-Thomson cryostat may also be used to facilitate cooling at least some known cryogenic liquid storage systems. However, known Joule-Thomson cryostats are generally expensive to install and/or may require an excessive amount of power to operate.

BRIEF DESCRIPTION

In one aspect, a method is provided for use in regulating a vapor pressure within a vessel. The method includes identifying whether the vapor pressure within the vessel is between a lower predefined pressure and a higher predefined pressure. A heat transfer between a temperature adjustment mechanism and the vessel is adjusted based on at least the vapor pressure within the vessel to facilitate regulating the vapor pressure within the vessel.

In another aspect, a controller is provided for use in regulating a vapor pressure within a vessel. The controller includes a memory device and a processor coupled to the memory device. The controller is programmed to identify whether the vapor pressure within the vessel is between a lower predefined pressure and a higher predefined pressure. A heat transfer between a temperature adjustment mechanism and the vessel is adjusted based on at least the vapor pressure within the vessel to facilitate regulating the vapor pressure within the vessel.

In yet another aspect, a vapor pressure regulation system is provided. The vapor pressure regulation system includes a vessel including a vessel wall that defines an enclosure, and a temperature adjustment mechanism coupled to the vessel. The temperature adjustment mechanism is configured to transfer heat between the vessel and the temperature adjustment mechanism to facilitate regulating a vapor pressure within the vessel.

The features, functions, and advantages described herein may be achieved independently in various embodiments of the present disclosure or may be combined in yet other embodiments, further details of which may be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION

The subject matter described herein relates generally to cryogenic storage systems and, more particularly, to methods and systems for use in regulating a vapor pressure within a vessel. In one embodiment, a vapor pressure regulation system is provided that includes a vessel including a vessel wall that defines an enclosure in which at least one cryogenic fluid is stored, and a temperature adjustment mechanism coupled to the vessel. The temperature adjustment mechanism enables heat to be transferred between the vessel and the ambient environment and/or a heat sink through the temperature adjustment mechanism to facilitate regulating a vapor pressure within the vessel. More specifically, in such an embodiment, heat transfer between the temperature adjustment mechanism and the vessel is regulated based on at least the vapor pressure within the vessel.

An exemplary technical effect of the methods and systems described herein includes at least one of: (a) determining and/or identifying whether a vapor pressure within a vessel is within a predefined pressure range; (b) determining and/or identifying whether a temperature adjustment mechanism is in a cooling mode or a heating mode; (c) adjusting heat transfer between the vessel and the ambient environment, a heat sink, and/or a heat source through the temperature adjustment mechanism based on at least the vapor pressure within the vessel; (d) increasing heat extracted from the vessel when the vapor pressure is higher than a predefined pressure defining a high end of the predefined pressure range; (e) decreasing heat imparted to the vessel when the vapor pressure is higher than a predefined pressure defining a high end of the predefined pressure range; (f); increasing heat imparted to the vessel when the vapor pressure is lower than a predefined pressure defining a low end of the predefined pressure range; and (g) decreasing heat extracted from the vessel when the vapor pressure is lower than a predefined pressure defining a low end of the predefined pressure range.

An element or step recited in the singular and proceeded with the word "a" or "an" should be understood as not excluding plural elements or steps unless such exclusion is explicitly recited. Moreover, references to "one embodiment" of the present invention and/or the "exemplary embodiment" are not intended to be interpreted as excluding the existence of additional embodiments that also incorporate the recited features.

Figure 1:
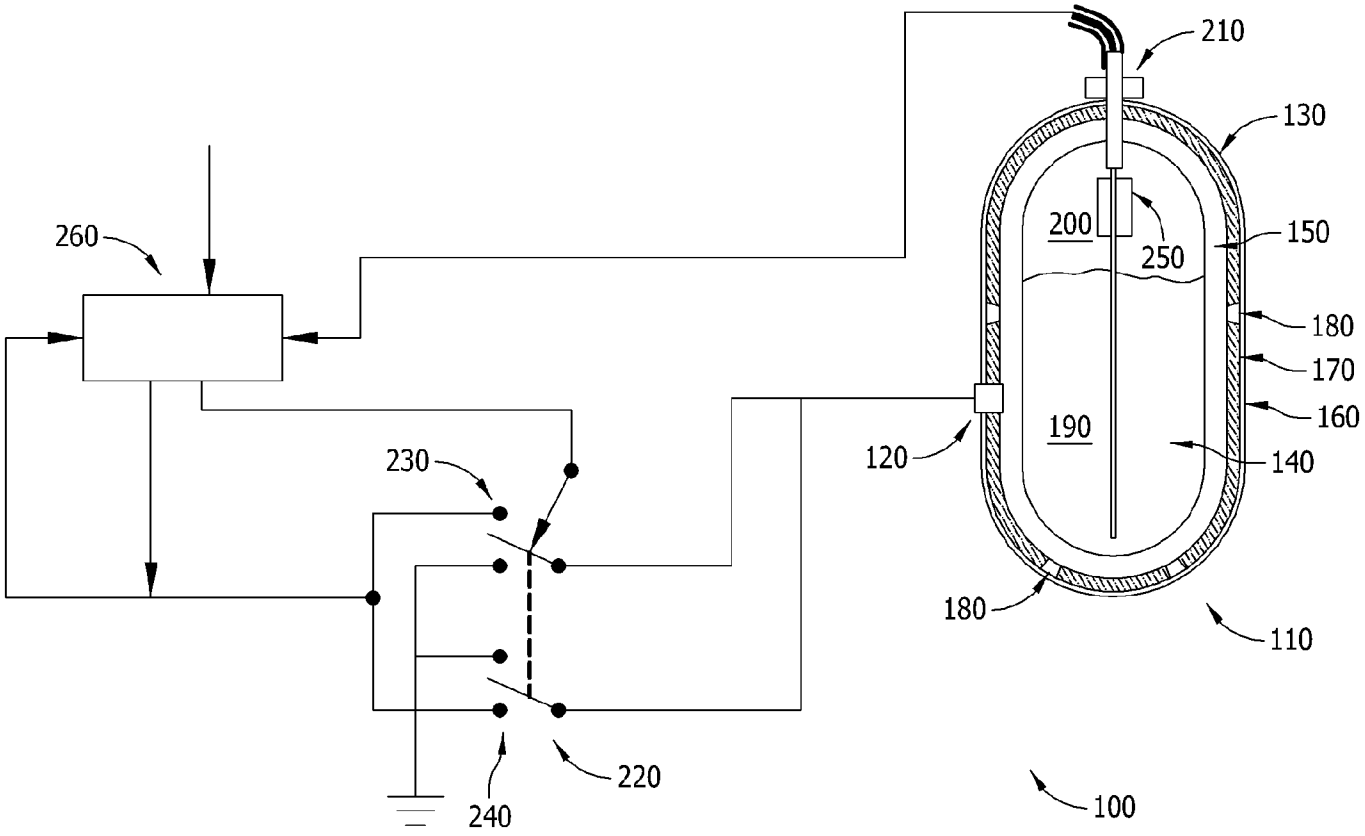
FIG. 1 is a schematic illustration of an exemplary vapor pressure regulation system and a temperature adjustment mechanism coupled to a cryogenic pressure vessel.

FIG. 1 is a schematic illustration of an exemplary vapor pressure regulation system 100 that includes a cryogenic pressure vessel system 110 and a temperature adjustment mechanism 120 that is coupled to cryogenic pressure vessel system 110. In the exemplary embodiment, temperature adjustment mechanism 120 may be coupled to an entire wall, a high heat penetration area, a hot spot, and/or an upper portion of cryogenic pressure vessel system 110 where vapor typically exists and/or is warmer. Moreover, in the exemplary embodiment, temperature adjustment mechanism 120 may extend across at least a portion of cryogenic pressure vessel system 110 and/or circumscribe at least a portion of cryogenic pressure vessel system 110. Alternatively, temperature adjustment mechanism 120 may be coupled to any portion of cryogenic pressure vessel system 110 that enables vapor pressure regulation system 100 to function as described herein.

In the exemplary embodiment, cryogenic pressure vessel system 110 includes a vessel wall 130 that defines an enclosure 140 within vessel system 110. In the exemplary embodiment, vessel wall 130 includes a pressure vessel or an inner shell 150 that is fabricated from a high strength and cryogenic fluid compatible material, an outer shell 160 that is fabricated from, for example, a stainless steel material, and an insulation layer 170 that extends between inner shell 150 and outer shell 160. In at least some embodiments, outer shell 160 and insulation layer 170 may be referred to as a vacuum jacket. In the exemplary embodiment, insulation layer 170 is a multilayer insulator that facilitates insulating vessel 130. Moreover, in the exemplary embodiment, at least one supporting mechanism 180 extends between inner shell 150 and outer shell 160 to facilitate increasing a structure integrity and/or strength of vessel wall 130. In the exemplary embodiment, supporting mechanism 180 is fabricated from a high strength and low-heat transfer material such as fiberglass. Alternatively, vessel wall 130 may have any number of shells and/or layers fabricated from any material that enables vessel wall 130 to function as described herein.

In the exemplary embodiment, a cryogenic liquid 190 and a vapor 200 are contained within cryogenic pressure vessel system 110. In the exemplary embodiment, a plumbing assembly 210 is coupled to cryogenic pressure vessel system 110 to enable cryogenic pressure vessel system 110 to be selectively filled with and/or drained of cryogenic liquid 190 and/or vapor 200. In at least one embodiment, plumbing assembly 210 includes wiring for sensors, such as temperature and/or pressure sensors. Alternatively, any fluid and/or combination of fluids may be contained within cryogenic pressure vessel system 110 that enables vapor pressure regulation system 100 to function as described herein.

In the exemplary embodiment, temperature adjustment mechanism 120 is configured to selectively transfer heat from or to cryogenic pressure vessel system 110 to facilitate regulating the vapor pressure within cryogenic pressure vessel system 110. In the exemplary embodiment, temperature adjustment mechanism 120 extracts heat from and/or imparts heat to cryogenic pressure vessel system 110. Because there is a direct relationship between temperature and pressure, by monitoring the fluid temperature and the vapor temperature, and by performing a heat transfer between temperature adjustment mechanism 120 and cryogenic pressure vessel system 110, pressure regulation system 100 can regulate a vapor pressure within cryogenic pressure vessel system 110.

In the exemplary embodiment, a switch 220 is coupled to temperature adjustment mechanism 120. More specifically, in the exemplary embodiment, switch 220 is movable between a first position 230 and a second position 240 to enable an operating mode of temperature adjustment mechanism 120 to be selectively changed between a heating mode and a cooling mode, respectively. In the exemplary embodiment, switch 220 is a double-pole, double-throw switch that may be automatically controlled according to control requirements. Alternatively, switch 220 may be any type of switch that enables vapor pressure regulation system 100 to function as described herein.

In the heating mode, in the exemplary embodiment, temperature adjustment mechanism 120 transfers heat from an ambient environment, which serves as a heat source (not shown) into cryogenic pressure vessel system 110. More specifically, in the exemplary embodiment, heat is imparted to cryogenic pressure vessel system 110 in a controlled manner that enables the vapor pressure to be maintained sufficiently high enough to generate a desired vaporized gas flow rate out of cryogenic pressure vessel system 110 for use in chemical processes and/or any other suitable purpose. In the cooling mode, temperature adjustment mechanism 120 enables heat to be transferred from cryogenic pressure vessel system 110 to the ambient environment and/or the heat sink. More specifically, the heat is selectively extracted from cryogenic pressure vessel system 110 in a controlled manner that enables the vapor pressure to be maintained sufficiently inside cryogenic pressure vessel system 110 within the predetermined limit.

In the exemplary embodiment, a sensor 250 is coupled to cryogenic pressure vessel system 110. More specifically, in the exemplary embodiment, sensor 250 is configured to detect the vapor pressure and/or vapor temperature within cryogenic pressure vessel system 110. Moreover, in the exemplary embodiment, sensor 250 is coupled to a controller 260 that is programmed to selectively regulate a pressure and/or a temperature within cryogenic pressure vessel system 110 based at least on the vapor pressure in cryogenic pressure vessel system 110, as described in more detail herein.

Figure 2:
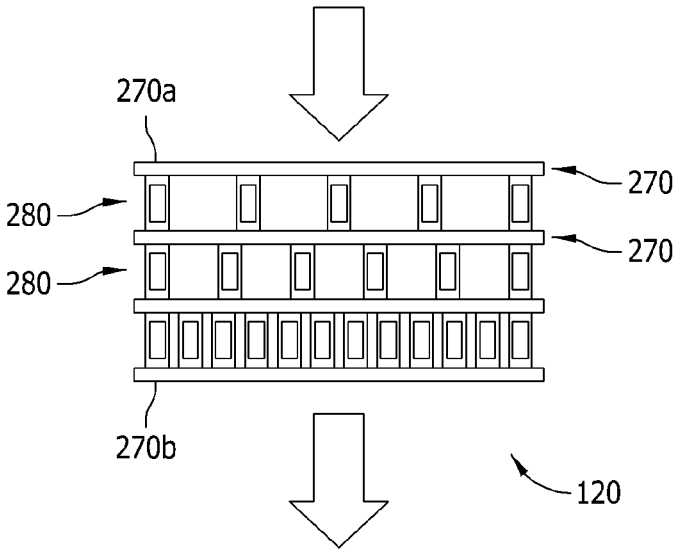
FIG. 2 is a schematic illustration of the temperature adjustment mechanism shown in FIG. 1.
Figure 3:
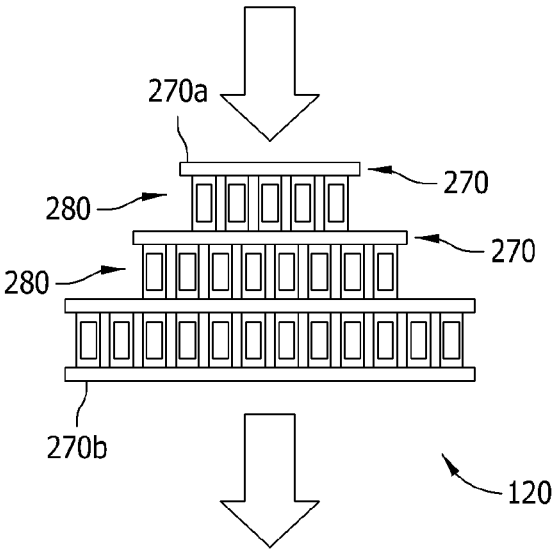
FIG. 3 is a schematic illustration of an alternative temperature adjustment mechanism that may be used with the vapor pressure regulation system shown in FIG. 1.

FIG. 2 is a schematic illustration of temperature adjustment mechanism 120. FIG. 3 is a schematic illustration of an alternative temperature adjustment mechanism 120. In the exemplary embodiment, temperature adjustment mechanism 120 includes a plurality of plates 270. In the exemplary embodiment, plates 270 are fabricated from a thermally conducting and/or electrically insulated material. More specifically, in the exemplary embodiment, a cold plate **270*a* is selectively coupled to vessel wall 130, and a hot plate 270*b* is selectively coupled to the ambient environment, a heat sink (not shown), and/or a heat source (not shown). In the exemplary embodiment, temperature adjustment mechanism 120 includes at least one stage 280. More specifically, as shown in FIG. 2, each plate 270 has a substantially similar surface area. Alternatively, as shown in FIG. 3, temperature adjustment mechanism 120 may be substantially pyramidal in shape. Temperature adjustment mechanism 120 may have any shape and/or configuration that enables vapor pressure regulation system 100** to function as described herein.

Figure 4:
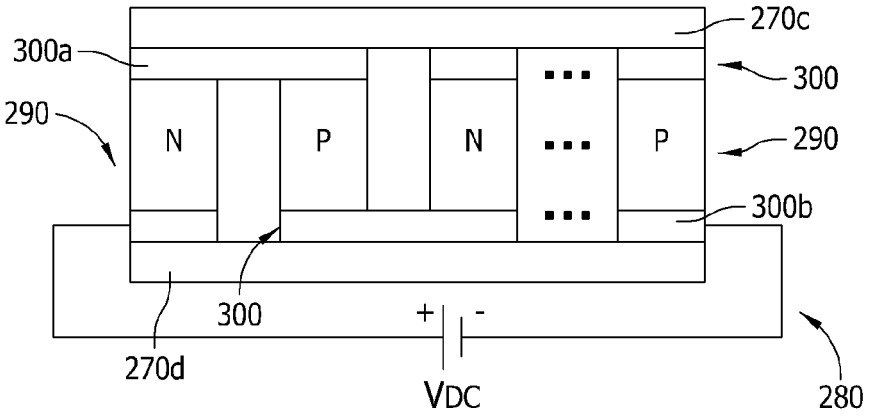
FIG. 4 is a schematic illustration of an exemplary layer that may be used with the temperature adjustment mechanism shown in FIG. 2.

As shown in more detail in FIG. 4, each stage 280 of temperature adjustment mechanism 120 includes a plurality of thermoelectric elements or semiconducting blocks 290 that are electrically coupled in series via a plurality of electric conductors 300. More specifically, in the exemplary embodiment, an inner conductor 300*a* is coupled between an inner plate 270*c* and a pair of semiconducting blocks 290, and an outer conductor 300*b* is coupled between outer plate 270*d* and another pair of semiconducting blocks 290. In the exemplary embodiment, each pair of semiconducting blocks includes an n-type semiconductor block and a p-type semiconductor block. Alternatively, each stage 280 may include any quantity and/or type of semiconductor blocks 290 that enables temperature adjustment mechanism 120 to function as described herein.

In the exemplary embodiment, stages 280 enable producing a thermoelectric effect or, more specifically, a direct conversion of temperature differences to electric voltage and vice versa. For example, in the exemplary embodiment, a voltage is created when cold plate 270*a* has a first temperature and hot plate 270*b* has a second temperature that is different from cold plate 270*a*. Moreover, a temperature difference between cold plate 270*a* and hot plate 270*b* is created when a voltage is applied to temperature adjustment mechanism 120.

Figure 5:
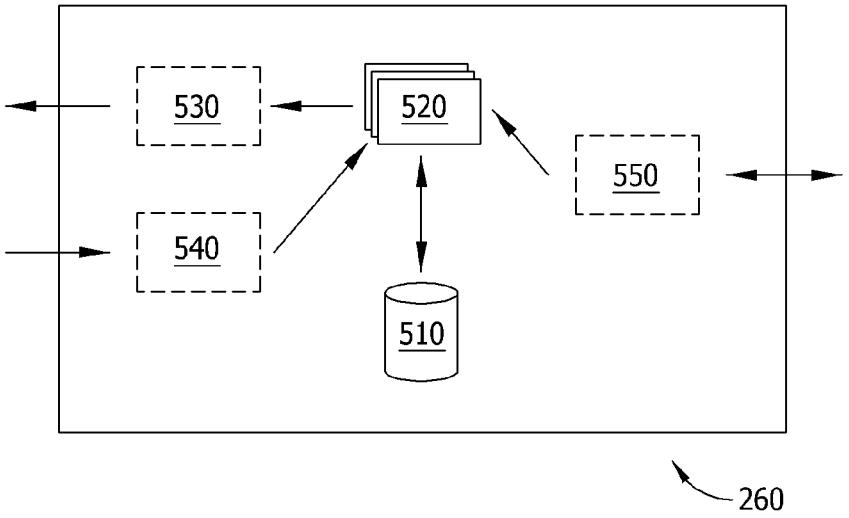
FIG. 5 is a schematic illustration of an exemplary controller that may be used to regulate a vapor pressure of the cryogenic pressure vessel shown in FIG. 1.

FIG. 5 is a schematic illustration of controller 260. In the exemplary embodiment, controller 260 includes a memory device 510 and a processor 520 coupled to memory device 510 for use in executing instructions. More specifically, in the exemplary embodiment, controller 260 is configurable to perform one or more operations described herein by programming memory device 510 and/or processor 520. For example, processor 520 may be programmed by encoding an operation as one or more executable instructions and by providing the executable instructions in memory device 510.

Processor 520 may include one or more processing units (e.g., in a multi-core configuration). As used herein, the term "processor" is not limited to integrated circuits referred to in the art as a computer, but rather broadly refers to a controller, a microcontroller, a microcomputer, a programmable logic controller (PLC), an application specific integrated circuit, and other programmable circuits.

In the exemplary embodiment, memory device 510 includes one or more devices (not shown) that enable information such as executable instructions and/or other data to be selectively stored and retrieved. In the exemplary embodiment, such data may include, but is not limited to, temperature data, pressure data, volume data, operational data, and/or control algorithms. Memory device 510 may also include one or more computer readable media, such as, without limitation, dynamic random access memory (DRAM), static random access memory (SRAM), a solid state disk, and/or a hard disk.

In the exemplary embodiment, controller 260 includes a presentation interface 530 that is coupled to processor 520 for use in presenting information to a user. For example, presentation interface 530 may include a display adapter (not shown) that may couple to a display device (not shown), such as, without limitation, a cathode ray tube (CRT), a liquid crystal display (LCD), a light-emitting diode (LED) display, an organic LED (OLED) display, an "electronic ink" display, and/or a printer. In some embodiments, presentation interface 530 includes one or more display devices.

Controller 260, in the exemplary embodiment, includes an input interface 540 for receiving input from the user. For example, in the exemplary embodiment, input interface 540 receives information suitable for use with the methods described herein. Input interface 540 is coupled to processor 520 and may include, for example, a joystick, a keyboard, a pointing device, a mouse, a stylus, a touch sensitive panel (e.g., a touch pad or a touch screen), and/or a position detector. It should be noted that a single component, for example, a touch screen, may function as both presentation interface 530 and as input interface 540.

In the exemplary embodiment, controller 260 includes a communication interface 550 that is coupled to processor 520. In the exemplary embodiment, communication interface 550 communicates with at least one remote device (not shown). For example, communication interface 550 may use, without limitation, a wired network adapter, a wireless network adapter, and/or a mobile telecommunications adapter. A network (not shown) used to couple controller 260 to the remote device may include, without limitation, the Internet, a local area network (LAN), a wide area network (WAN), a wireless LAN (WLAN), a mesh network, and/or a virtual private network (VPN) or other suitable communication means.

For example, in the exemplary embodiment, controller 260 may transmit and/or receive signals from the remote sensor related to, without limitation, a pressure of the vapor and/or liquid, a temperature of the vapor and/or liquid, a voltage applied to temperature adjustment mechanism 120, and/or a current applied to temperature adjustment mechanism 120. The remote sensor may also transmit and/or receive controls signals to, without limitation, temperature adjustment mechanism 120 and/or switch 220. In the exemplary embodiment, switch 220 facilitates adjusting a heat transfer through temperature adjustment mechanism 120 by executing a command signal received from controller 260.

Figure 6:
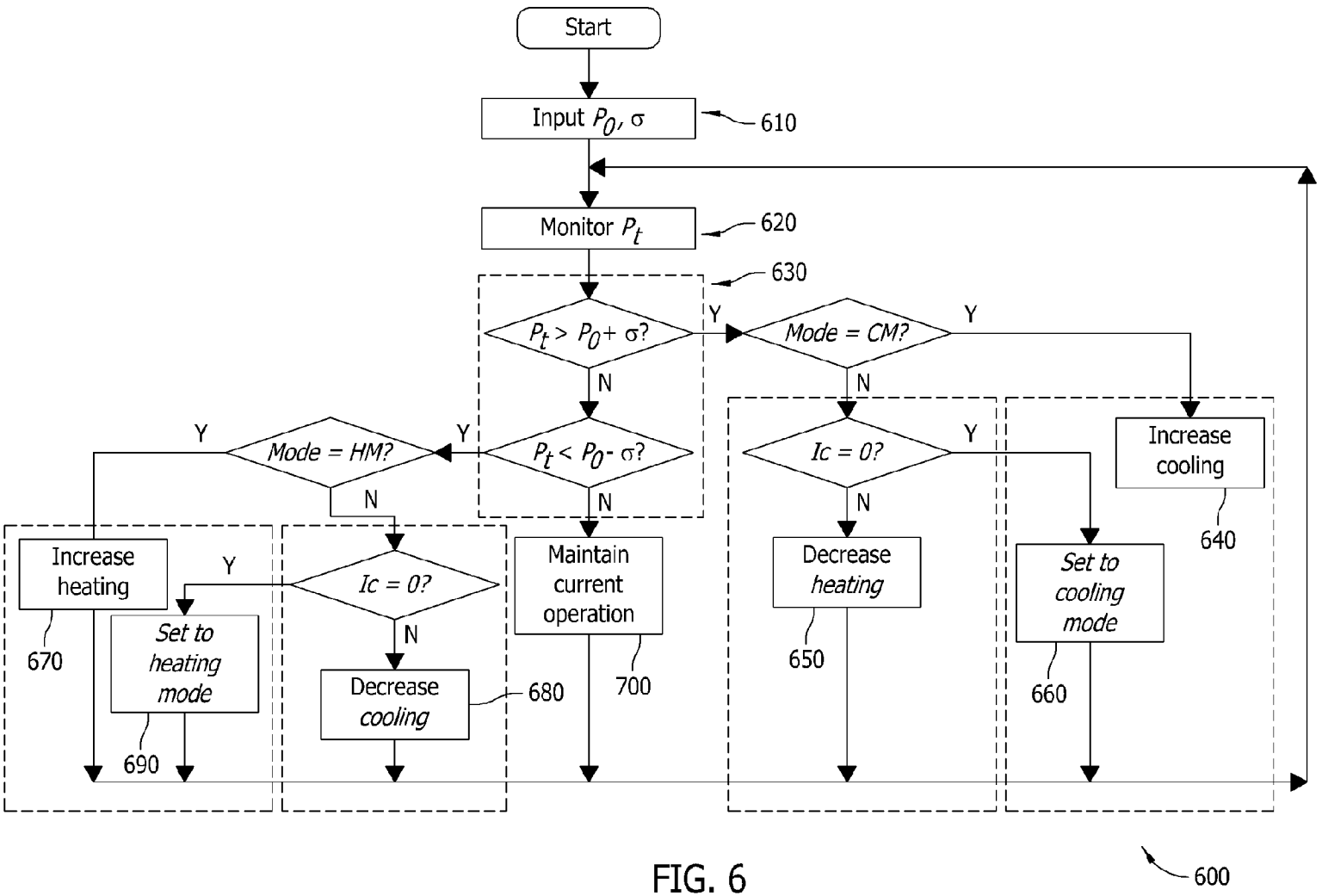
FIG. 6 is a flowchart of an exemplary method that may be implemented using the controller shown in FIG. 5 to regulate the vapor pressure of the cryogenic pressure vessel shown in FIG. 1.

FIG. 6 is a flowchart of an exemplary method 600 that may be implemented using controller 260 to regulate the vapor pressure of cryogenic pressure vessel system 110. In the exemplary embodiment, a predetermined pressure ($P_0$) and/or a predetermined range ($\sigma$) are input 610 into controller 260, and controller 260 monitors 620 a vapor pressure ($P_t$) within cryogenic pressure vessel system 110. In one embodiment, a higher level control system (not shown) may determine the command values (i.e., $P_0$ and/or $\sigma$). Moreover, during operation of the exemplary embodiment, the vapor pressure may change over time. As such, in the exemplary embodiment, controller 260 determines and/or identifies 630 whether the vapor pressure within cryogenic pressure vessel system 110 is within the predetermined pressure range. More specifically, in the exemplary embodiment, controller 260 is programmed to identify whether the vapor pressure is between a lower predefined pressure and a higher predefined pressure (i.e., $P_0-\sigma<P_t<P_0+\sigma$).

For example, based on at least the vapor pressure within cryogenic pressure vessel system 110, in the exemplary embodiment, controller 260 may selectively adjust the heat transfer between temperature adjustment mechanism 120 and cryogenic pressure vessel system 110. More specifically, in the exemplary embodiment, if the vapor pressure is higher than the higher predefined pressure, and temperature adjustment mechanism 120 is in the cooling mode, then controller 260 increases 640 the cooling of cryogenic pressure vessel system 110 (i.e., heat is extracted from cryogenic pressure vessel system 110) to facilitate decreasing a pressure within cryogenic pressure vessel system 110 and, thus, decreases the vapor temperature within cryogenic pressure vessel system 110. In the exemplary embodiment, if the vapor pressure is higher than the higher predefined pressure, and temperature adjustment mechanism 120 is not in the cooling mode (e.g., temperature adjustment mechanism 120 is in the heating mode), then controller 260 decreases 650 the heating of cryogenic pressure vessel system 110 (i.e., heat is imparted to cryogenic pressure vessel system 110) and/or sets 660 temperature adjustment mechanism 120 to the cooling mode to facilitate decreasing a pressure within cryogenic pressure vessel system 110 and, thus, decrease the vapor temperature within cryogenic pressure vessel system 110.

In the exemplary embodiment, if the vapor pressure is lower than the lower predefined pressure, and temperature adjustment mechanism 120 is in the heating mode, then controller 260 increases 670 the heating of cryogenic pressure vessel system 110 to facilitate increasing a pressure within cryogenic pressure vessel system 110 and, thus, increases the vapor temperature within cryogenic pressure vessel system 110. In the exemplary embodiment, if the vapor pressure is lower than the lower predefined pressure, and temperature adjustment mechanism 120 is not in the heating mode (e.g., temperature adjustment mechanism 120 is in the cooling mode), then controller 260 decreases 680 the cooling of cryogenic pressure vessel system 110 and/or sets 690 temperature adjustment mechanism 120 to the heating mode to facilitate increasing a pressure within cryogenic pressure vessel system 110 and, thus, increases the vapor temperature within cryogenic pressure vessel system 110.

In the exemplary embodiment, if the vapor pressure is between the lower predefined pressure and the higher predefined pressure, then controller 260 substantially maintains 700 the current operation of vapor pressure regulation system 100. In the exemplary embodiment, the vapor pressure is regulated with respect to predetermined vapor pressures. In at least some embodiments, predetermined pressures and/or predetermined ranges may be dynamically adjusted within a closed-loop dynamic vapor pressure regulation system to facilitate managing the vapor pressure required by the cryogenic vapor flow rate out of the pressure vessel system. As such, vapor pressure regulation system 100 is configured to adjust and/or change the predetermined pressure and/or the predetermined range based on at least one previously detected vapor temperature and/or vapor pressure.

Exemplary embodiments of systems and methods for regulating a vapor pressure in a cryogenic storage system are described above in detail. The systems and methods are not limited to the specific embodiments described herein, but rather, components of systems and/or steps of the method may be utilized independently and separately from other components and/or steps described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for use in regulating vapor pressure within a vessel, said method comprising:

receiving, by a controller, one of a predefined pressure value and a predefined pressure range from an input interface;

receiving, by the controller, a measurement of the vapor pressure within the vessel;

in response to determining that the measurement of the vapor pressure within the vessel is not at the predefined pressure value or within the predefined pressure range, automatically determining, with the controller, whether to cause an operating mode of a thermoelectric temperature adjustment mechanism to change to a heating mode or a cooling mode, wherein the thermoelectric temperature adjustment mechanism is coupled to the vessel; and transmitting, via the controller, a control signal to cause the thermoelectric temperature adjustment mechanism to change to the heating mode from the cooling mode, or to change to the cooling mode from the heating mode, based on the determination of whether to cause the operating mode of the thermoelectric temperature adjustment mechanism to change to the heating mode or to the cooling mode, wherein the heating mode causes heat to transfer to the vessel from a heat source, and wherein the cooling mode causes a transfer of heat from the vessel to a cold source.

2. The method in accordance with claim 1 further comprising:

identifying, with the controller, whether the temperature adjustment mechanism is in a cooling mode; and increasing, with the controller, heat extracted from the vessel when the vapor pressure is higher than a predefined pressure defining a high end of the predefined pressure range.

3. The method in accordance with claim 1 further comprising:

identifying, with the controller, whether the temperature adjustment mechanism is in a heating mode;

setting, with the controller, the temperature adjustment mechanism to a cooling mode; and increasing, with the controller, heat extracted from the vessel when the vapor pressure is higher than a predefined pressure defining a high end of the predefined pressure range.

4. The method in accordance with claim 1 further comprising:

identifying, with the controller, whether the temperature adjustment mechanism is in a heating mode; and decreasing, with the controller, heat imparted to the vessel when the vapor pressure is higher than a predefined pressure defining a high end of the predefined pressure range.

5. The method in accordance with claim 1 further comprising:

identifying, with the controller, whether the temperature adjustment mechanism is in a heating mode; and increasing, with the controller, heat imparted to the vessel when the vapor pressure is lower than a predefined pressure defining a low end of the predefined pressure range.

6. The method in accordance with claim 1 further comprising:

identifying, with the controller, whether the temperature adjustment mechanism is in a cooling mode;

setting, with the controller, the temperature adjustment mechanism to a heating mode; and increasing, with the controller, heat imparted to the vessel when the vapor pressure is lower than a predefined pressure defining a low end of the predefined pressure range.

7. The method in accordance with claim 1 further comprising:

identifying, with the controller, whether the temperature adjustment mechanism is in a cooling mode; and decreasing, with the controller, heat extracted from the vessel when the vapor pressure is lower than a predefined pressure defining a low end of the predefined pressure range.

8. The method in accordance with claim 1, wherein the thermoelectric temperature adjustment mechanism includes at least two stages that each include a plurality of semiconducting blocks that are electrically coupled in series via a plurality of electric conductors.

9. The method in accordance with claim 1, wherein the thermoelectric temperature adjustment mechanism is coupled to the vessel, wherein the thermoelectric temperature adjustment mechanism includes a cold plate coupled to a vessel wall and a hot plate coupled to at least one of an ambient environment, a heat sink, and a heat source.

10. The method in accordance with claim 9, wherein the thermoelectric temperature adjustment mechanism comprises a plurality of thermoelectric elements positioned between the cold plate and the hot plate.

11. The method in accordance with claim 9, wherein a switch is coupled to the thermoelectric temperature adjustment mechanism, said method further comprising adjusting, with the controller, a heat transfer between the vessel and at least one of the ambient environment, the heat sink, and the heat source when the switch is moved between a first position and a second position.

12. The method in accordance with claim 1 further comprising adjusting, with the controller, an amount of voltage applied to the thermoelectric temperature adjustment mechanism to return the vapor pressure back to within the predefined pressure range, and determining what amount to adjust the amount of voltage applied to the thermoelectric temperature adjustment mechanism.

13. A vapor pressure regulation system comprising:

a vessel comprising a vessel wall that defines an enclosure;

a thermoelectric temperature adjustment mechanism coupled to said vessel, said temperature adjustment mechanism configured to transfer heat between said vessel and said temperature adjustment mechanism to facilitate regulating a vapor pressure within said vessel; and a controller for use in regulating vapor pressure within the vessel, said controller comprising a memory device and a processor coupled to said memory device and an input interface, said controller programmed to:

receive one of a predefined pressure value and a predefined pressure range from an input interface;

receive a measurement of the vapor pressure within said vessel;

in response to determining that the measurement of the vapor pressure within said vessel is not at the predefined pressure value or within the predefined pressure range, automatically determine whether to cause an operating mode of said thermoelectric temperature adjustment mechanism to change to a heating mode or a cooling mode; and transmit a control signal to cause said thermoelectric temperature adjustment mechanism to change to the heating mode from the cooling mode, or to change to the cooling mode from the heating mode, based on the determination of whether to cause the operating mode of said thermoelectric temperature adjustment mechanism to change to the heating mode or to the cooling mode, wherein the heating mode causes heat to transfer to said vessel from a heat source, and wherein the cooling mode causes a transfer of heat from said vessel to a cold source.

14. The vapor pressure regulation system in accordance with claim 13, wherein said controller is further programmed to:

identify whether the vapor pressure within said vessel is between a lower predefined pressure and a higher predefined pressure; and adjust the heat transfer between said thermoelectric temperature adjustment mechanism and said vessel based on at least the vapor pressure within said vessel.

15. The vapor pressure regulation system in accordance with claim 13, wherein said thermoelectric temperature adjustment mechanism comprises a cold plate and a hot plate, said cold plate coupled to said vessel wall, said hot plate coupled to a heat sink.

16. The vapor pressure regulation system in accordance with claim 15, wherein said thermoelectric temperature adjustment mechanism comprises a plurality of thermoelectric elements positioned between said cold plate and said hot plate.

17. The vapor pressure regulation system in accordance with claim 13 further comprising a switch coupled to said thermoelectric temperature adjustment mechanism, wherein said switch is movable between a first position and a second position.

18. The vapor pressure regulation system in accordance with claim 13 further comprising a sensor coupled to said vessel, wherein said sensor is configured to detect at least one of the vapor pressure and temperature within said vessel.

19. The vapor pressure regulation system in accordance with claim 13, wherein said thermoelectric temperature adjustment mechanism includes at least two stages that each include a plurality of semiconducting blocks that are electrically coupled in series via a plurality of electric conductors.

20. The vapor pressure regulation system in accordance with claim 13, wherein said controller is further programmed to adjust an amount of voltage applied to said thermoelectric temperature adjustment mechanism to return the vapor pressure back to within the predefined pressure range, and by what amount to adjust the amount of voltage applied to said thermoelectric temperature adjustment mechanism.

* * * * *